US005242124A

United States Patent [19]

Latzel et al.

[11] Patent Number: 5,242,124

[45] Date of Patent: Sep. 7, 1993

[54] APPARATUS FOR CONVEYING, COMMINUTING AND MIXING MATERIALS COMPRISING/NOT COMPRISING SOLID MATTER

[76] Inventors: Manfred Latzel, Sonntagstrasse 15, D-4350 Recklinghausen; Armin Stock, Hölkeskampring 98, D-4690 Herne 1, both of Fed. Rep. of Germany

[21] Appl. No.: 918,276

[22] Filed: Jul. 22, 1992

[30] Foreign Application Priority Data

Jul. 23, 1991 [DE] Fed. Rep. of Germany ..... 4124408

[51] Int. Cl.[5] ..... B02C 23/36

[52] U.S. Cl. ..... 241/46.11; 241/89.4; 210/174; 415/121.1

[58] Field of Search ..... 241/46.11, 88.4, 89.3; 210/173, 174; 415/121.1

[56] References Cited

U.S. PATENT DOCUMENTS

| | | | |
|---|---|---|---|
| 2,085,326 | 6/1937 | Nordell | 210/174 |
| 2,320,514 | 6/1943 | Dundin, Jr. | 210/174 |
| 2,763,375 | 9/1956 | Shaughnessy | 210/174 |
| 3,005,597 | 10/1961 | Neidl . | |
| 3,060,862 | 10/1962 | Neidl | 241/46.11 X |
| 3,113,734 | 12/1963 | Neidl . | |
| 3,247,970 | 4/1966 | Tellesma | 210/174 |
| 3,502,274 | 3/1970 | Neidl | 241/46.11 |
| 3,785,574 | 1/1974 | Rosenquest, Jr. | 241/46.11 X |
| 3,843,062 | 10/1974 | Neidl | 241/46.11 |
| 3,845,908 | 11/1974 | Friedenreich et al. . | |
| 3,891,152 | 6/1975 | Guggenheimer | 241/88.4 |
| 4,383,652 | 5/1983 | Osborne et al. | 241/85.4 |
| 4,694,993 | 9/1987 | Endo et al. | 246/46.11 |
| 5,018,674 | 5/1991 | Williams | 241/88.4 |

FOREIGN PATENT DOCUMENTS

| | | | |
|---|---|---|---|
| 55724 | 1/1939 | Denmark | 210/174 |
| 1528778 | 12/1970 | Fed. Rep. of Germany | 241/46.11 |

*Primary Examiner*—Mark Rosenbaum
*Assistant Examiner*—Frances Chin
*Attorney, Agent, or Firm*—Palmatier, Sjoquist & Helget

[57] ABSTRACT

An apparatus for conveying, comminuting and mixing materials comprising/not comprising solid matter having a stator (8) featuring teeth extended inwardly comprises a plurality of racks (13) arranged alongside each other. These racks (13) are held at the ends of the stator (8) in fixing rings (15). The racks (13) may be arranged with a spacing (17) from each other which is defined by blades (16) formed on the fixing rings. The toothed sections of the rotor or impeller (7) and of the racks (13) may be arranged replaceable. Between the inner wall (22) of the casing (2) and the outer wall (21) of the stator cylinder a discharge passage (20) is provided which in a special embodiment is flared scroll-shaped in the direction of the discharge opening (6).

11 Claims, 3 Drawing Sheets

Figure 1:
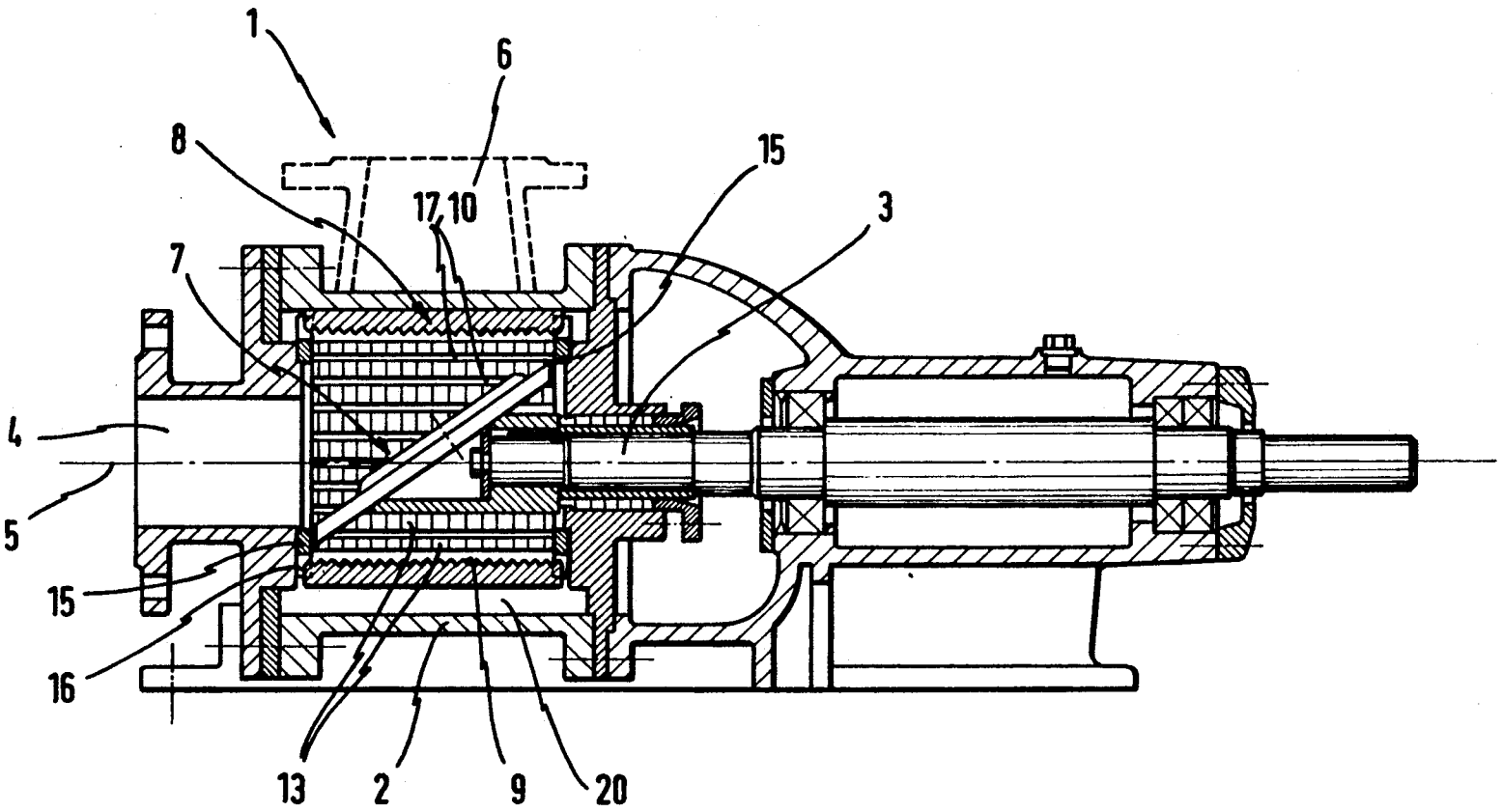

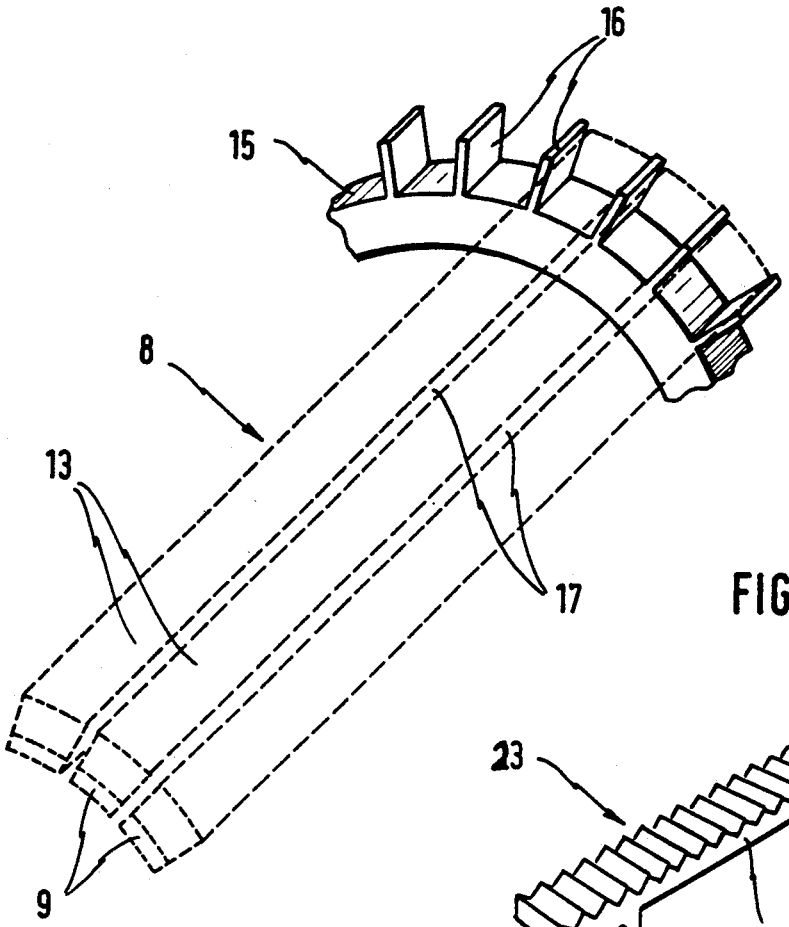
FIG. 2
FIG. 3
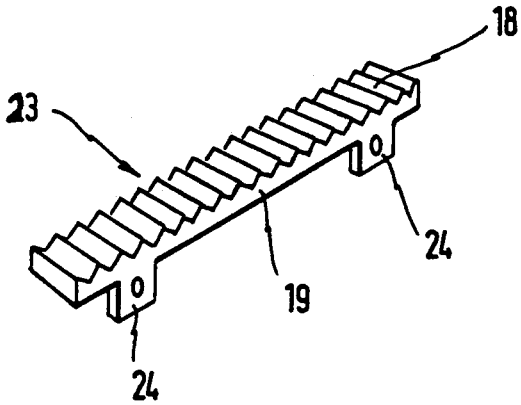
FIG. 5
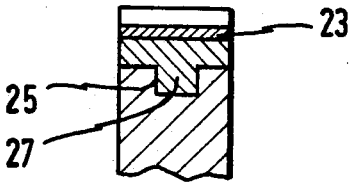
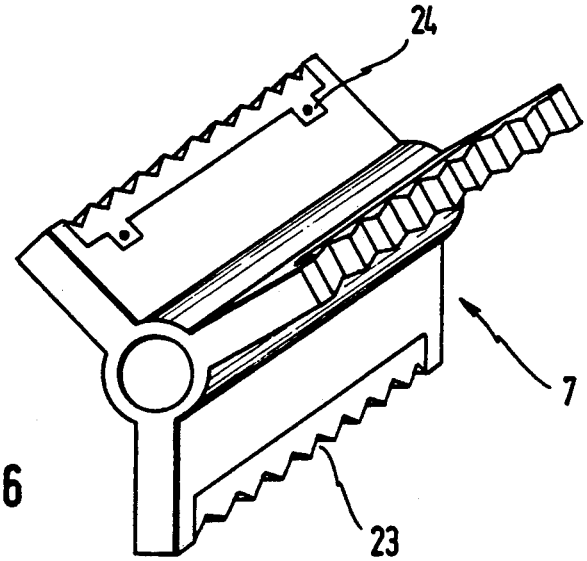
FIG. 6

FIG. 4a
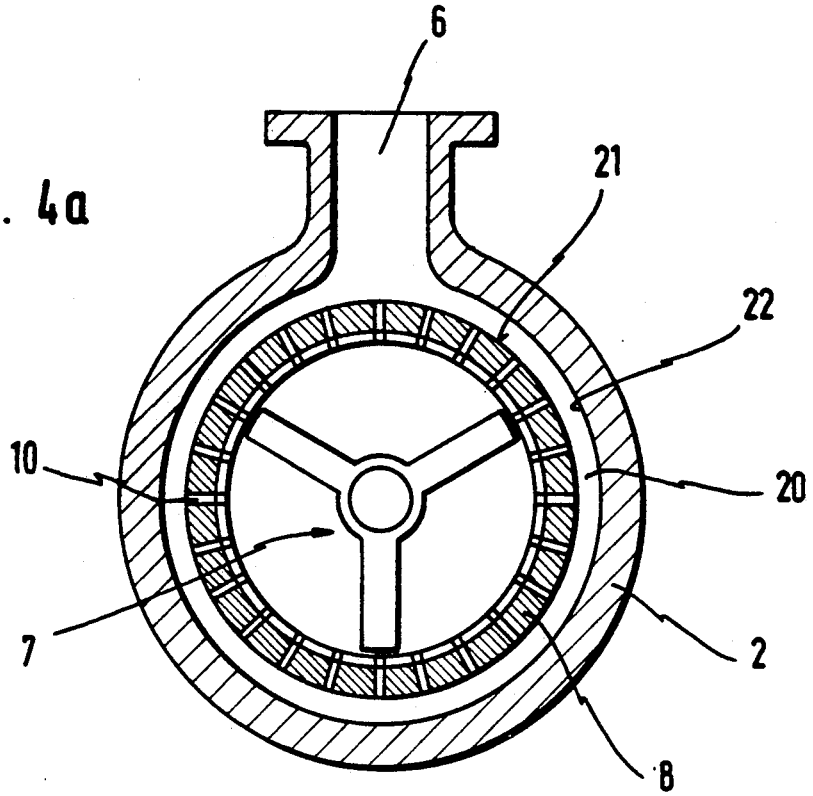
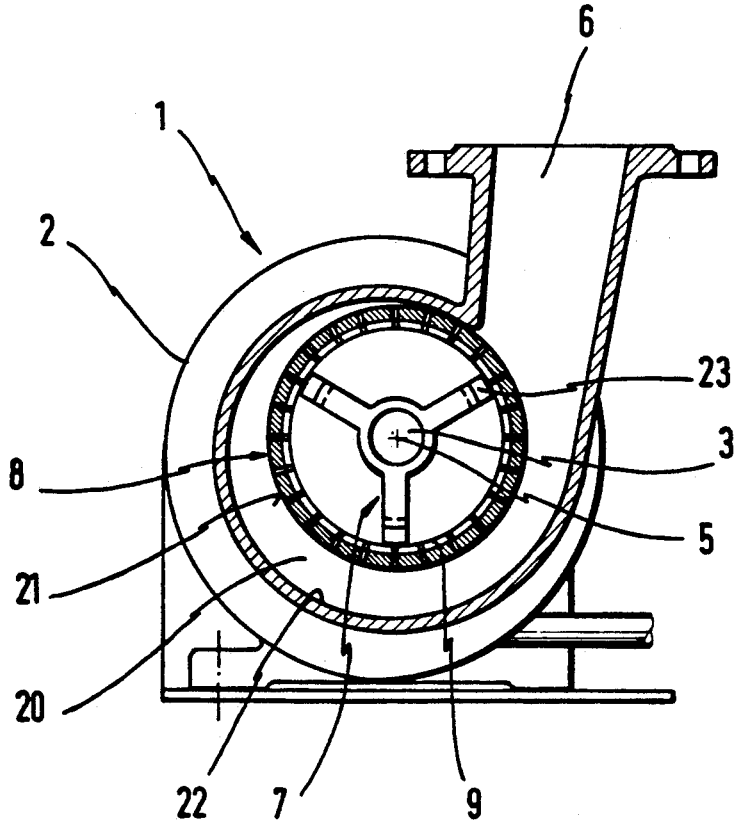
FIG. 4b

APPARATUS FOR CONVEYING, COMMINUTING AND MIXING MATERIALS COMPRISING/NOT COMPRISING SOLID MATTER

The invention relates to an apparatus for conveying, comminuting and mixing materials comprising/not comprising solid matter.

The apparatus finds application particularly in sewage handling as well as in any branch of industry in which homogenizing, dispersion or conditioning is required in the liquid phase. A further application is the field of mixing operations.

One such apparatus is known from prior art in which the stator consists of a cylindrical drum having teeth extending inwardly to mate at some distance away with the teeth of the rotor or impeller. The interior of this stator drum has a flow connection to the inlet opening via an end opening and to the discharge opening via grooves or drillings in the cylinder wall provided in the region of this discharge opening. The remaining wall of the cylinder has no other opening.

This known apparatus has the disadvantage that the stator drum is configured as a one-piece component, whereby the teeth protruding inwardly need to be machined at high cost on a lathe. Subsequently slots or openings having to be provided in the drum at the prescribed position so that the conveyed material is able to emerge from within the drum in the region of the discharge opening.

A further disadvantage is that the conveyed material is able to pass through the stator cylinder wall only at the position of the discharge opening, so that here a bottleneck situation arises for the flow of conveyed material.

From patent DE-AS 14 03 857 an apparatus for comminuting and conveying fluidized solid matter is known in which the casing is scroll-shaped.

The stator wall comprises a one-piece cylinder having tooth-shaped ribs on the inside. In these ribs openings are formed to allow the materials to flow through the scroll-shaped discharge passage to the discharge opening.

From patent DE-OS 21 52 704 a machine for conveying suspensions and viscous substances having a cage-like casing with openings is known. This casing comprises members of a gear rack type arranged alongside each other accommodated at their ends by annular grooves. These annular grooves are formed on flanges which constitute the upper and lower edge of the cage-like casing. To space the racks accordingly the side walls have projections supported by the corresponding neighbouring member.

This configuration has the disadvantage that material can additionally accumulate in the gap between the rack members which will clog at the projections.

The object of the present invention is based on creating an apparatus of the field concerned, in which the stator ensures noproblem discharge of the conveyed material despite a simple configuration which is cheap to produce.

This object is achieved according to the invention by the features of the main claim. In accordance with the stated features the stator cylinder now comprises essentially two fixing rings, each arranged at the ends, together with a plurality of racks which are particularly simple to manufacture.

Having to machine a complete stator cylinder by a complicated procedure in a lathe or a milling machine is avoided. In addition, there is the advantage that the fixing rings are castings which also contribute towards reducing costs.

It is to advantage that the the circular outer periphery of the fixing rings is provided with blades the thickness of which in circumferential direction determines the spacing of the racks and therefore the gap width between the racks, thus eliminating the need for high-cost machining to produce the passageways for the material before or after it is comminuted.

It may be of advantage in certain embodiments of the apparatus to provide the blades on the fixing ring only over part of the circumference of the fixing ring and to arrange the racks alongside each other gapless in the remaining circumferential area. alongside each other in the remaining area of the circumference.

Due to the high degree of efficiency the energy required is considerably less when compared to that of a usual apparatus of this kind, whilst achieving better quality of handling.

It may also be favourable to configure the racks two-part, whereby the tooth part of the rack can comprise a material which is adapted to the later area of application of the apparatus. This tooth part can be soldered or bolted to the carrier part.

One particularly advantageous measure may be seen in configuring the casing cross-sectionally scroll-shaped, the discharge passage between the circumference of the stator and the inner wall of the casing being flared circumferentially in the direction of the discharge opening.

In the embodiments having the discharge passage between the inner wall of the casing and the outer circumference of the casing it is favourable when each rack of the stator is spaced away from its neighbouring rack.

Yet a further advantageous embodiment contributing towards reducing costs can be seen in configuring the toothing of the rotor or impeller as a replaceable tooth part.

One particularly advantageous feature is to be appreciated in that the gap between the racks of the stator and the gap distance between the teeth of the stator and the coacting impeller is the same.

Accordingly the comminuting effect is achieved not only between the coacting teeth but also by the material passing through the gap between the racks so that the quality of comminution and efficiency are substantially increased.

Embodiments of the invention will now be explained in more detail with reference to the drawings in which FIG. 1 is an axial section through a completely assembled apparatus having an inclined impeller disk and rack stator, FIG. 2 is a perspective view of part of a stator comprising racks with a fixing ring, FIG. 3 is a tooth part of an impeller, FIG. 4*a* is a cross-section through an apparatus having a constant circumferential discharge passage, FIG. 4*b* is an alternative embodiment having a scroll-shaped or spirally-shaped casing and a flared discharge passage FIG. 5 is a partial sectional view of means for securing a tooth part to an impeller blade, and FIG. 6 is a perspective view of a impeller having tooth parts arranged thereon.

FIG. 1 shows a section through an apparatus for conveying, comminuting and mixing material comprising/not comprising solid matter as is usual in sewage handling. This apparatus features a casing 2 on a stub shaft 3 protruding thereinto on which an impeller 7 is provided to turn with the shaft. At its front end the casing 2 is provided with an inlet opening 4 and with a discharge opening 6 at right angles to the shaft axis 5. In this arrangement the axis of the discharge opening 6 is able to intersect the shaft axis or to be suitably located tangentially to a suitable circumferential diameter to achieve a favourable flow condition.

The casing accommodates a cylindrical stator 8 in which the impeller secured to the stub shaft 3 turns. The cylindrically configured stator 8 has an annular shaped toothing 9 which coacts with corresponding teeth formed on the impeller 7.

In the embodiment shown in FIG. 1 the impeller comprises an inclined standing disk as is known from prior art. Due to this inclined arrangement the disk nutates in axial direction with the result that a pumping effect is produced due to the centrifugal acceleration of the material being conveyed.

The stator 8 comprises single racks 13, each of which is held at the cylindrical ends of the stator by two fixing rings 15. The outer circumference of these fixing rings 15 features blades 16 over the full outer circumference or merely over a partial section thereof, depending on the intended application (viz. FIG. 2) the material thickness of these blades determining the gap 17 between the racks 13.

In FIG. 4*a*, between the outer wall 21 of the cylindrical stator 8 and the inner wall (22) of the casing 2 a discharge passage 20 is provided which has a consistent width over the full circumference.

In the example embodiments as shown by contrast in FIG. 4*b* the casing is located eccentrially offset from the shaft axis 5 or configured flared scroll-shaped so that the discharge passage can be flared in circumference and the conveyed material is able to flow more easily over the complete circumference of the stator to the the discharge passage and to the discharge opening 6.

In both embodiments each rack of the cylindrical stator 8 is secured over the full periphery to the fixing rings 15 with a gap spacing to its neighbouring rack, so that the material to be conveyed and comminuted is able to emerge over the full circumferential surface area of the cylinder and thus offers merely an exceptionally slight resistance to flow.

In FIG. 6 a three-bladed rotor or impeller is shown, the toothing of which is configured as a separate tooth part 23 in the region facing the impeller. In the region facing the impeller this tooth part shown in detail in FIG. 3 features means for establishing the tooth part on the actual impeller. In the example embodiment shown, these means comprise a protruding lug 24 which can be inserted in a corresponding cutout in the impeller to which it can be bolted.

For certain applications this tooth part as well as the racks 13 can be configured two-part, the actual toothed section 18 comprising a material which is hardened or capable of being hardened, the actual carrying section (19) being a simple steel casting adapted to the function required.

FIG. 5 shows a further means of fastening the tooth part to the impeller as a section view, either by means of a solder joint or by means of end bolting. Configuring the stator cylinder in the form of racks located alongside and spaced away from each other enables the gap 28 between the teeth of the stator and the teeth of the impeller to be arranged particularly close, it being found from experience that a spacing corresponding to that of the racks from each other is particularly favourable.

In special embodiments it may prove favourable to maintain the space between the impeller teeth and the assigned teeth of the stator less than that of the racks away from each other. On the other hand it may prove favourable to configure the distance between the teeth of the impeller and those of the stator greater than the spacing between the racks when the material to be conveyed has a particularly high percentage of solid matter.

We claim:

1. An apparatus for conveying, comminuting and mixing materials, comprising a casing having an inner wall and an inlet opening; a stub shaft extending into said casing opposite said inlet opening; a discharge opening in said casing at a right angle to said stub shaft; a rotor secured to said stub shaft and extending up to said inlet opening; a stator arranged about said rotor in said casing, spaced inwardly from said casing inner wall; said stator further comprising two spaced-apart fixing rings, each ring having an outer circumference with radially extending blades of predetermined thickness and spacing, and a plurality of racks seated between said blades an extending between said spaced-apart fixing rings; said racks having an arrangement of teeth facing said rotor and said rotor having an arrangement of teeth facing said rack teeth and coacting therewith; whereby material being conveyed is forced between said racks and between said casing inner wall and said stator, and out through said discharge opening.

2. An apparatus according to claim 1, wherein said blades on said fixing ring are provided only over part of the circumference of said fixing ring and said racks are arranged in the remaining area of the circumference alongside each other.

3. An apparatus according to claim 2, wherein said rack is configured as a two-part component, the material of the tooth part being specially hardened.

4. An apparatus according to claim 3, wherein a non-abrading tooth part is soldered to a carrying part.

5. An apparatus according to claim 3, wherein said tooth part is bolted to a carrying part.

6. An apparatus according to claim 1, wherein a discharge passage between an outer circumference of said stator and the inner wall of said casing is flared in the peripheral and working direction towards said discharge opening.

7. An apparatus according to claim 6, wherein each rack of said stator comprises a gap spacing to its neighbouring rack.

8. An apparatus according to claim 7, wherein the teeth said rotor is configured as a replaceable tooth part.

9. An apparatus according to claim 8, wherein the tooth part of said rotor is configured with at least one fastening means permitting said tooth part to be secured locally with respect to the remaining part of said rotor.

10. An apparatus according to claim 9, wherein said replaceable tooth part is bolted to said rotor.

11. An apparatus according to claim 1, wherein a gap between said racks equals a spacing between the teeth of said stator and of said coacting rotor.

* * * * *